US011107398B2

(12) United States Patent
Kim et al.

(10) Patent No.: US 11,107,398 B2
(45) Date of Patent: Aug. 31, 2021

(54) SELECTIVE PIXEL DRIVER AND DISPLAY DEVICE INCLUDING THE SAME

(71) Applicant: SAMSUNG DISPLAY CO., LTD., Yongin-si (KR)

(72) Inventors: Wontae Kim, Hwaseong-si (KR); Jihye Kim, Hwaseong-si (KR); Jae-Hyeon Jeon, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/740,022

(22) Filed: Jan. 10, 2020

(65) Prior Publication Data

US 2020/0335037 A1 Oct. 22, 2020

(30) Foreign Application Priority Data

Apr. 18, 2019 (KR) ..... 10-2019-0045634

(51) Int. Cl.
*G09G 3/3225* (2016.01)
*G09G 3/3275* (2016.01)
*G09G 3/3266* (2016.01)

(52) U.S. Cl.
CPC ..... *G09G 3/3225* (2013.01); *G09G 3/3266* (2013.01); *G09G 3/3275* (2013.01); *G09G 2310/0286* (2013.01); *G09G 2310/08* (2013.01); *G09G 2320/0257* (2013.01); *G09G 2330/021* (2013.01); *G09G 2380/02* (2013.01)

(58) Field of Classification Search
CPC ..... G09G 2330/021; G09G 2380/02; G09G 2310/04; G06F 1/3265
See application file for complete search history.

(56) References Cited

U.S. PATENT DOCUMENTS 10,424,252 B2 * 9/2019 Kong ..... G09G 3/2096
2013/0278624 A1 * 10/2013 Abe ..... G06F 3/147 345/619
2014/0098015 A1 * 4/2014 Wang ..... G09G 3/3677 345/100
2018/0123080 A1 * 5/2018 Kim ..... H01L 27/3262
2020/0365827 A1 * 11/2020 Yamazaki ..... H05B 33/14

FOREIGN PATENT DOCUMENTS

KR 10-2015-0136669 12/2015

* cited by examiner

*Primary Examiner* — Laurence J Lee
(74) *Attorney, Agent, or Firm* — F. Chau & Associates, LLC

(57) ABSTRACT

A pixel driver includes a plurality of stages, with each stage including a pixel driving signal generator, a shift register, and a selection circuit. The pixel driving signal generator generates a pixel driving signal. The shift register receives image data and the pixel driving signal and generates an output control signal for determining whether to output the pixel driving signal based on the image data and the pixel driving signal. The selection circuit selectively outputs the pixel driving signal in response to the output control signal.

21 Claims, 9 Drawing Sheets

SELECTIVE PIXEL DRIVER AND DISPLAY DEVICE INCLUDING THE SAME

CROSS-REFERENCE TO RELATED APPLICATION

This application claims priority under 35 U.S.C. § 119 to Korean Patent Application No. 10-2019-0045634, filed on Apr. 18, 2019 in the Korean Intellectual Property Office (KIPO), the disclosure of which is incorporated by reference herein in its entirety.

TECHNICAL FIELD

Exemplary embodiments of the inventive concept relate to a pixel driver and a display device including the pixel driver.

DISCUSSION OF RELATED ART

Generally, a display device may include a display panel including a plurality of pixels, a plurality of data lines, a plurality of scan lines, and a plurality of emission control lines, a data driver configured to provide a data signal to the data lines, a scan driver configured to provide a scan signal to the scan lines, and an emission control driver configured to provide an emission control signal to the emission control lines.

Each of the scan driver and the emission control driver may include a plurality of stages that are dependently connected to one another. Because the stages are dependently connected to one another, the scan signal and the emission control signal are continuously supplied to an entire area of the display panel even when a partial display driving of the display device, by which an image is displayed on a partial area of the display panel, is performed. As such, power consumption may be increased.

SUMMARY

According to an exemplary embodiment of the inventive concept, a pixel driver includes a plurality of stages. Each of the plurality of stages includes a pixel driving signal generator configured to generate a pixel driving signal, a shift register configured to receive image data and the pixel driving signal and to generate an output control signal for determining whether to output the pixel driving signal based on the image data and the pixel driving signal, and a selection circuit configured to selectively output the pixel driving signal in response to the output control signal.

In an exemplary embodiment of the inventive concept, the pixel driving signal may include a scan signal.

In an exemplary embodiment of the inventive concept, the pixel driving signal may include an emission control signal.

In an exemplary embodiment of the inventive concept, the pixel driving signal generated by a pixel driving signal generator of an nth stage may be supplied as a carry signal to a pixel driving signal generator of an (n+1)th stage, where n is a natural number greater than or equal to 1.

In an exemplary embodiment of the inventive concept, the shift register may include a first input terminal to which the image data is applied, a second input terminal to which the pixel driving signal is applied, and an output terminal at which the output control signal is output.

In an exemplary embodiment of the inventive concept, the selection circuit may include a first switch configured to output the pixel driving signal in response to the output control signal and a second switch configured to output an off signal having a preset voltage level in response to the output control signal.

In an exemplary embodiment of the inventive concept, the first switch may include a first-type switching element, and the second switch may include a second-type switching element.

According to an exemplary embodiment of the inventive concept, a display device may include a display panel including a plurality of pixels, a data driver configured to supply a data signal to the plurality of pixels, a pixel driver including a plurality of stages, and configured to supply a pixel driving signal to the plurality of pixels, and a timing controller configured to generate control signals for controlling the data driver and the pixel driver. Each of the plurality of stages may include a pixel driving signal generator configured to generate the pixel driving signal, a shift register configured to receive image data and the pixel driving signal and to generate an output control signal for determining whether to output the pixel driving signal based on the image data and the pixel driving signal, and a selection circuit configured to selectively output the pixel driving signal in response to the output control signal.

In an exemplary embodiment of the inventive concept, the pixel driver may include a scan driver, and the pixel driving signal may include a scan signal.

In an exemplary embodiment of the inventive concept, the pixel driver may include an emission control driver, and the pixel driving signal may include an emission control signal.

In an exemplary embodiment of the inventive concept, the pixel driving signal generated by a pixel driving signal generator of an nth stage may be supplied as a carry signal to a pixel driving signal generator of an (n+1)th stage, where n is a natural number greater than or equal to 1.

In an exemplary embodiment of the inventive concept, the shift register may include a first input terminal to which the image data is applied, a second input terminal to which the pixel driving signal is applied, and an output terminal at which the output control signal is output.

In an exemplary embodiment of the inventive concept, the selection circuit may include a first switch configured to output the pixel driving signal in response to the output control signal and a second switch configured to output an off signal having a preset voltage level in response to the output control signal.

In an exemplary embodiment of the inventive concept, the first switch may include a first-type switching element, and the second switch may include a second-type switching element.

In an exemplary embodiment of the inventive concept, the display device may perform a partial display driving to display an image, corresponding to the image data, on a partial area of the display panel.

In an exemplary embodiment of the inventive concept, stages among the plurality of stages, corresponding to an area where the image is not displayed, may supply an off signal to corresponding pixels.

In an exemplary embodiment of the inventive concept, the data driver may be configured not to supply the data signal to pixels included in an area where the image is not displayed.

In an exemplary embodiment of the inventive concept, the display panel may include a foldable display panel.

In an exemplary embodiment of the inventive concept, stages among the plurality of stages, corresponding to a folded area of the foldable display panel, may supply an off signal to corresponding pixels.

In an exemplary embodiment of the inventive concept, the data driver may be configured not to supply the data signal to pixels included in a folded area of the foldable display panel.

According to an exemplary embodiment of the inventive concept, a pixel driver may include a plurality of stages. An $n^{th}$ stage of the plurality of stages may include a pixel driving signal generator configured to generate a scan signal or an emission control signal as a pixel driving signal and output the pixel driving signal to a shift register and an $(n+1)^{th}$ stage, the shift register configured to receive image data and the pixel driving signal, to generate an output control signal based on the image data and the pixel driving signal, and output the output control signal to a selection circuit, and the selection circuit configured to receive the output control signal and to output one of the pixel driving signal or an off signal in response to the output control signal. Here, n is a natural number greater than or equal to 1.

BRIEF DESCRIPTION OF THE DRAWINGS

The above and other features of the inventive concept will be better understood by describing in detail exemplary embodiments thereof with reference to the accompanying drawings.

DETAILED DESCRIPTION OF THE EMBODIMENTS

Figure 1:
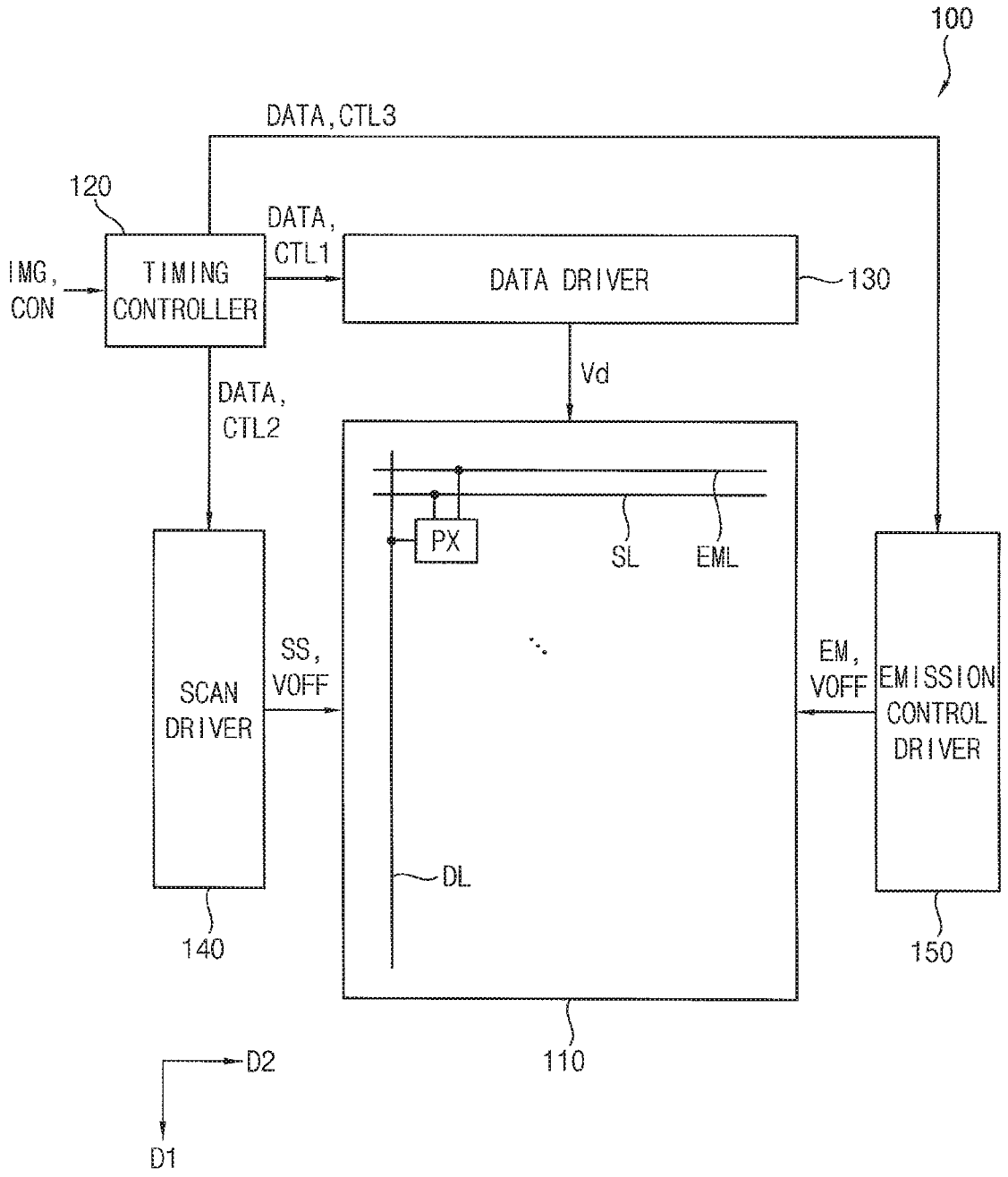
FIG. 1 is a block diagram illustrating a display device according to an exemplary embodiment of the inventive concept.

Exemplary embodiments of the inventive concept provide a pixel driver that can partially provide a scan signal and an emission control signal when a partial display driving of a display device is performed.

Exemplary embodiments of the inventive concept also provide a display device including a pixel driver that can partially provide a scan signal and an emission control signal when a partial display driving of the display device is performed.

Hereinafter, exemplary embodiments of the inventive concept will be explained in detail with reference to the accompanying drawings. Like reference numerals may refer to like elements throughout this application.

Figure 2:
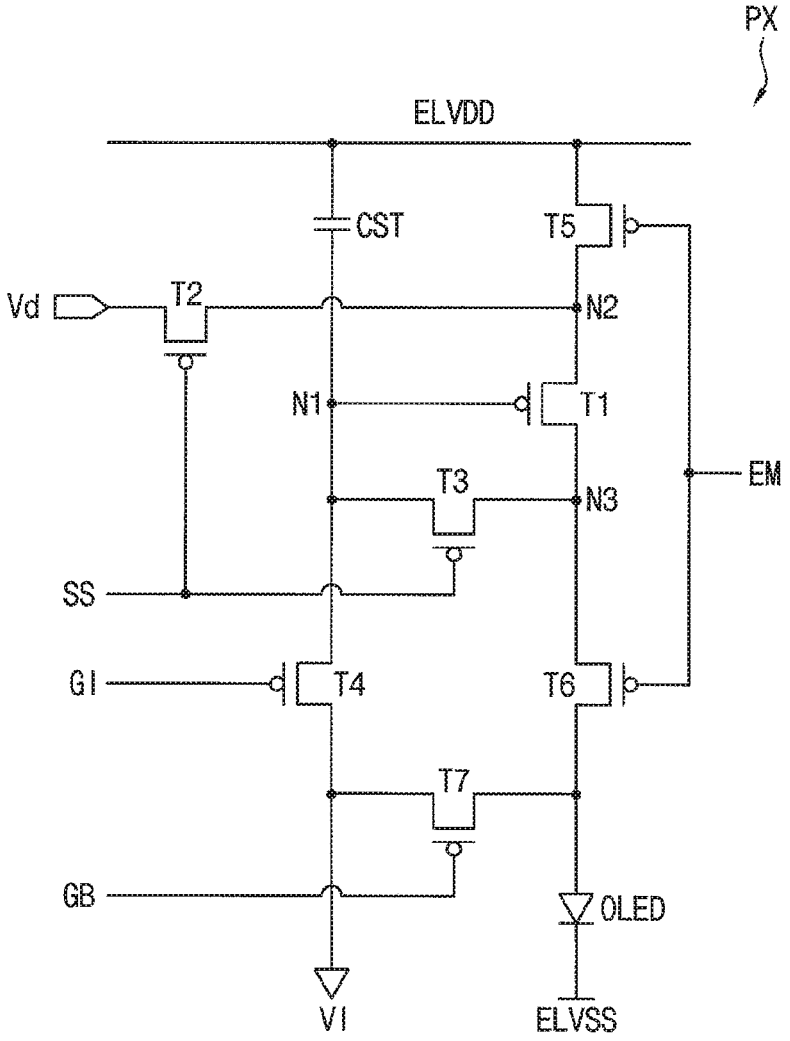
FIG. 2 is a circuit diagram illustrating a pixel included in the display device of FIG. 1 according to an exemplary embodiment of the inventive concept.

FIG. 1 is a block diagram illustrating a display device according to an exemplary embodiment of the inventive concept. FIG. 2 is a circuit diagram illustrating a pixel included in the display device of FIG. 1 according to an exemplary embodiment of the inventive concept.

Referring to FIG. 1, a display device 100 may include a display panel 110, a timing controller 120, a data driver 130, and a pixel driver. The pixel driver may include a scan driver 140 and an emission control driver 150. Alternatively, the pixel driver may include one of the scan driver 140 and the emission control driver 150.

The display panel 110 may include a plurality of data lines DL, a plurality of scan lines SL, and a plurality of emission control lines EML. In addition, the display panel 110 may include a plurality of pixels PX electrically connected to the data lines DL, the scan lines SL, and the emission control lines EML. The data lines DL may extend in a first direction D1 and may be arranged in a second direction D2 intersecting the first direction D1. The scan lines SL and the emission control lines EML may extend in the second direction D2 and may be arranged in the first direction D1.

Referring to FIG. 2, each of the pixels PX may include first to seventh switching elements T1, T2, T3, T4, T5, T6, and T7, a storage capacitor CST, and an organic light emitting diode OLED.

The first switching element T1 may include a gate electrode connected to a first node N1, a first electrode connected to a second node N2, and a second electrode connected to a third node N3. The first electrode of the first switching element T1 may be a source electrode, and the second electrode of the first switching element T1 may be a drain electrode.

The second switching element T2 may include a gate electrode to which a scan signal SS is applied, a first electrode to which a data signal Vd is applied, and a second electrode connected to the second node N2. The first electrode of the second switching element T2 may be a source electrode, and the second electrode of the second switching element T2 may be a drain electrode.

The third switching element T3 may include a gate electrode to which the scan signal SS is applied, a first electrode connected to the first node N1, and a second electrode connected to the third node N3. The first electrode of the third switching element T3 may be a source electrode, and the second electrode of the third switching element T3 may be a drain electrode.

The fourth switching element T4 may include a gate electrode to which a data initialization gate signal GI is applied, a first electrode to which an initialization voltage VI is applied, and a second electrode connected to the first node N1. The first electrode of the fourth switching element T4 may be a source electrode, and the second electrode of the fourth switching element T4 may be a drain electrode.

The fifth switching element T5 may include a gate electrode to which an emission control signal EM is applied, a first electrode to which a high power supply voltage ELVDD is applied, and a second electrode connected to the second node N2. The first electrode of the fifth switching element T5 may be a source electrode, and the second electrode of the fifth switching element T5 may be a drain electrode.

The sixth switching element T6 may include a gate electrode to which the emission control signal EM is applied, a first electrode connected to the third node N3, and a second electrode connected to an anode of the organic light emitting diode OLED. The first electrode of the sixth switching element T6 may be a source electrode, and the second electrode of the sixth switching element T6 may be a drain electrode.

The seventh switching element T7 may include a gate electrode to which an organic light emitting diode initialization gate signal GB is applied, a first electrode to which the initialization voltage VI is applied, and a second electrode connected to the anode of the organic light emitting diode OLED. The first electrode of the seventh switching element T7 may be a source electrode, and the second electrode of the seventh switching element T7 may be a drain electrode.

The storage capacitor CST may include a first electrode to which the high power supply voltage ELVDD is applied and a second electrode connected to the first node N1.

The organic light emitting diode OLED may include the anode and a cathode to which a low power supply voltage ELVSS is applied.

As shown in FIG. 2, the first to seventh switching elements T1, T2, T3, T4, T5, T6, and T7 may be implemented as P-channel metal oxide semiconductor (PMOS) transistors. In this case, the first to seventh switching elements T1, T2, T3, T4, T5, T6, and T7 may be turned on in response to a signal (voltage) having a low level and may be turned off in response to a signal having a high level.

FIG. 2 illustrates a pixel in which the first to seventh switching elements T1, T2, T3, T4, T5, T6, and T7 are implemented as the PMOS transistors, but the first to seventh switching elements T1, T2, T3, T4, T5, T6, and T7 are not limited thereto. For example, the first to seventh switching elements T1, T2, T3, T4, T5, T6, and T7 may be implemented as N-channel metal oxide semiconductor (NMOS) transistors. In this case, the first to seventh switching elements T1, T2, T3, T4, T5, T6, and T7 may be turned on in response to a signal having a high level and may be turned off in response to a signal having a low level.

Referring back to FIG. 1, the timing controller 120 may convert input image data IMG supplied from an external device into image data DATA and may generate a first control signal CTL1 and a pixel control signal for controlling the driving of the image data DATA. The pixel control signal may include a second control signal CTL2 and a third control signal CTL3. The timing controller 120 may convert the input image data IMG supplied from the external device into the image data DATA by applying an algorithm (e.g., dynamic capacitance compensation (DCC), etc.), for correcting the image quality, to the input image data IMG. When the timing controller 120 does not include the algorithm for correcting or improving the image quality, the input image data IMG may be output as the image data DATA. The timing controller 120 may supply the image data DATA to the data driver 130, the scan driver 140, and the emission control driver 150. The timing controller 120 may receive an input control signal CON from the external device to generate the first control signal CTL1 supplied to the data driver 130, the second control signal CTL2 supplied to the scan driver 140, and the third control signal CTL3 supplied to the emission control driver 150. For example, the first control signal CTL1 may include a horizontal start signal and at least one clock signal, and the second control signal CTL2 and the third control signal CTL3 may include a vertical start signal and at least one clock signal.

The data driver 130 may generate the data signal Vd corresponding to the image data DATA based on the first control signal CTL1 and supply the data signal Vd to the pixels PX of the display panel 110 through the data lines DL. When the display device 100 performs a partial display driving to display an image, corresponding to the image data DATA, on a partial area of the display panel 110, the data driver 130 may not supply the data signal Vd to the pixels PX included in an area where the image is not displayed. For example, the data driver 130 may include a shift register, a latch unit, a digital-analog converter (DAC), and an output buffer unit, and the DAC and the output buffer unit may be separated from each other in the area where the image is not displayed, so that the data signal Vd may not be supplied to the pixels PX included in the area where the image is not displayed.

The pixel driver may include a plurality of stages and may supply a pixel driving signal to the pixels PX. The stages of the pixel driver may be dependently connected to one another. Each of the stages may output the pixel driving signal or an off signal VOFF based on the image data DATA and the pixel driving signal. When the image data DATA includes the area where the image is not displayed, the stages corresponding to an area where the image is displayed, among the stages of the pixel driver, may output the pixel driving signal to the pixels PX of the display panel 110, and the stages corresponding to the area where the image is not displayed, among the stages of the pixel driver, may output the off signal VOFF to the display panel 110.

In an exemplary embodiment of the inventive concept, the pixel driver may be the scan driver 140, and the pixel driver signal may be the scan signal SS. The scan driver 140 may generate the scan signal SS based on the image data DATA and the second control signal CTL2. When the display device 100 performs the partial display driving to display the image, corresponding to the image data DATA, on the partial area of the display panel 110, the stages of the scan driver 140 corresponding to the area where the image is displayed may supply the scan signal SS to the second switching element T2 and the third switching element T3 included in the pixel PX of FIG. 2, and the stages of the scan driver 140 corresponding to the area where the image is not displayed may supply the off signal VOFF to the second switching element T2 and the third switching element T3 included in the pixel PX of FIG. 2. The off signal VOFF may have a voltage level for turning off the second switching element T2 and the third switching element T3. For example, when the display device 100 is a foldable display device, the scan driver 140 may supply the off signal VOFF to the area where the display panel 110 is folded so that a user may not view the image.

In an exemplary embodiment of the inventive concept, the pixel driver may be the emission control driver 150, and the pixel driving signal may be the emission control signal EM. The emission control driver 150 may generate the emission control signal EM based on the image data DATA and the third control signal CTL3. When the display device 100 performs the partial display driving to display the image corresponding to the image data DATA on the partial area of the display panel 110, the stages of the emission control driver 150 corresponding to the area where the image is displayed may supply the emission control signal EM to the fifth switching element T5 and the sixth switching element T6 included in the pixel PX of FIG. 2, and the stages of the emission control driver 150 corresponding to the area where the image is not displayed may supply the off signal VOFF to the fifth switching element T5 and the sixth switching element T6 included in the pixel PX of FIG. 2. The off signal VOFF may have a voltage level for turning off the fifth switching element T5 and the sixth switching element T6. For example, when the display device 100 is a foldable display device, the emission control driver 150 may supply the off signal VOFF to the area where the display panel 110 is folded so that the user may not view the image.

Hereinafter, the structure and operation of the pixel driver will be described in detail with reference to FIGS. 3 to 10.

As described above, according to an exemplary embodiment of the inventive concept, the display device 100 allows the stages of the pixel driver to selectively output the pixel driving signal and the off signal VOFF, so that power consumption can be reduced when partial display driving, by which the image corresponding to the image data DATA is displayed on a partial area of the display panel 110, is performed. In addition, each of the stages controls whether to output the pixel driving signal to facilitate the partial display driving.

Figure 3:
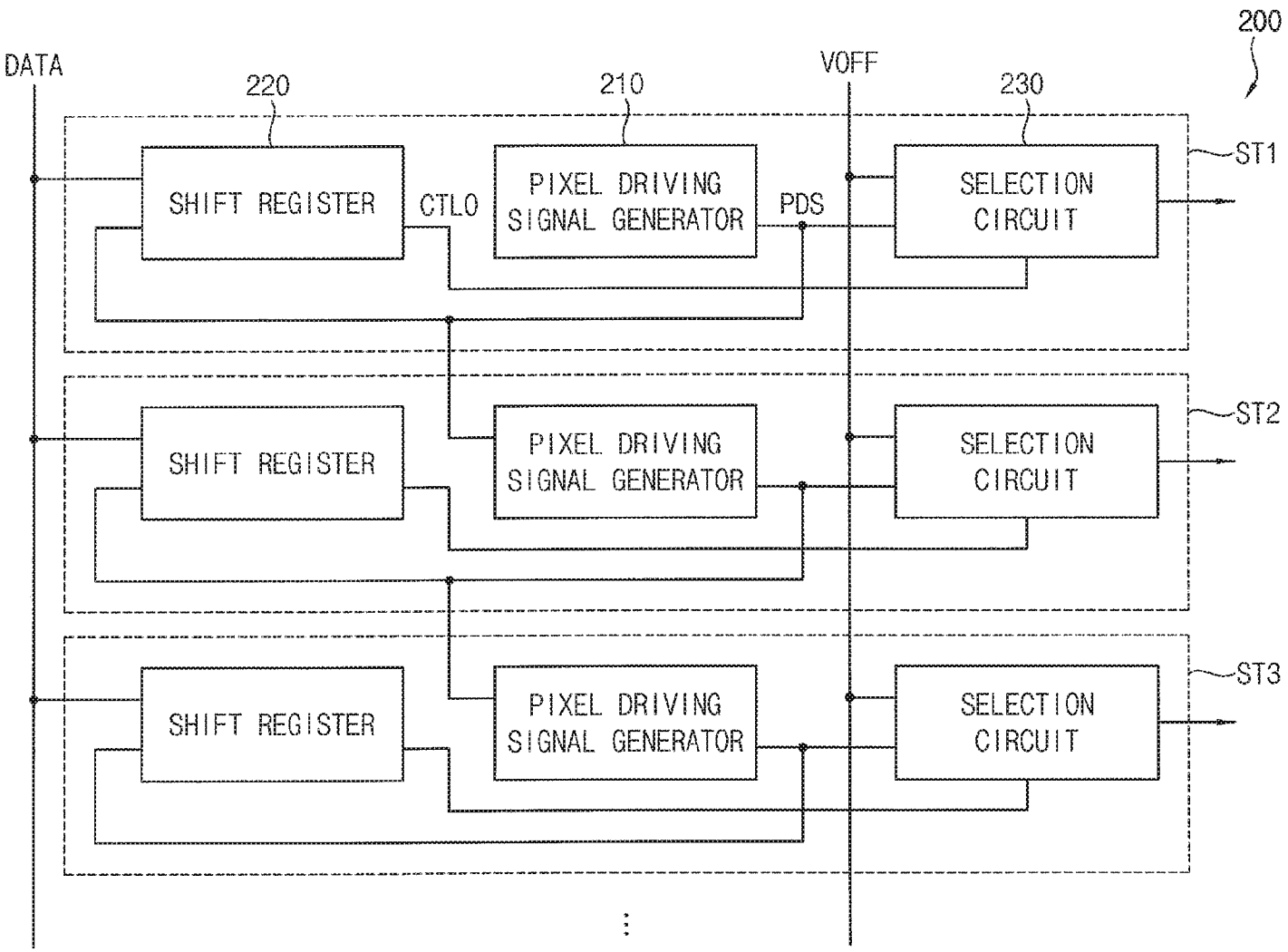
FIG. 3 is a block diagram illustrating a pixel driver included in the display device of FIG. 1 according to an exemplary embodiment of the inventive concept.
Figure 4:
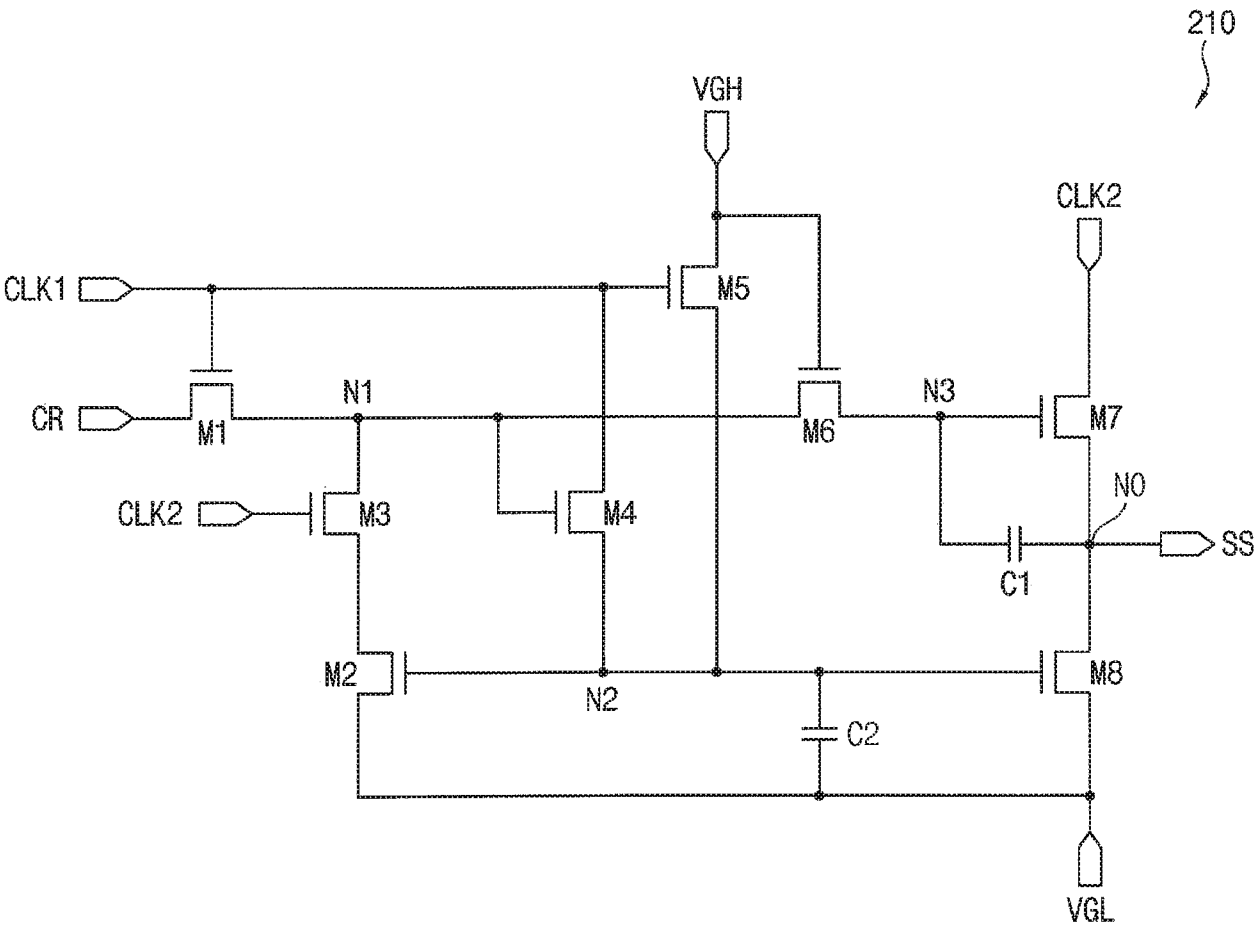
FIG. 4 is a circuit diagram illustrating a pixel driving signal generator included in the pixel driver of FIG. 3 according to an exemplary embodiment of the inventive concept.
Figure 5:
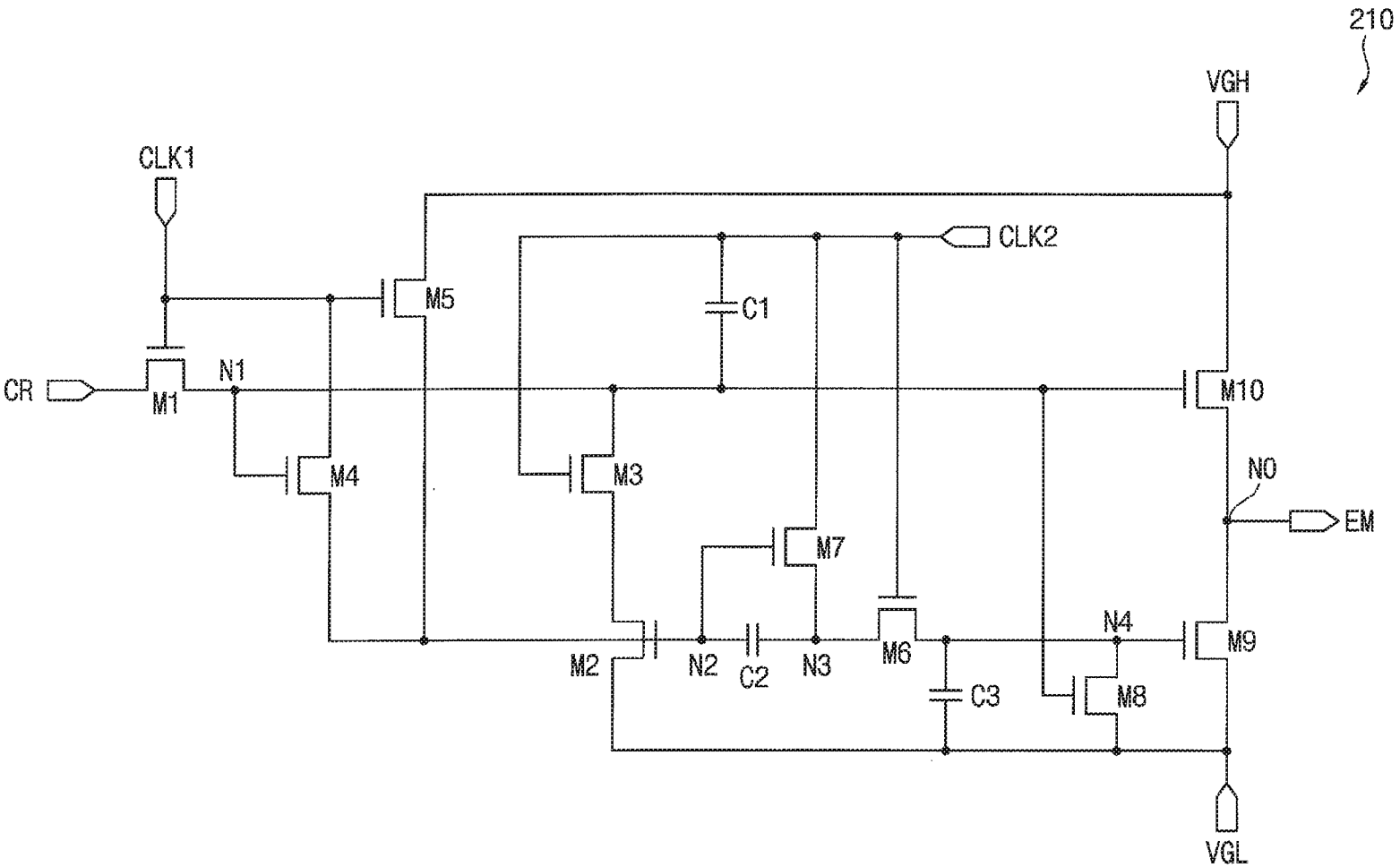
FIG. 5 is a circuit diagram illustrating a pixel driving signal generator included in the pixel driver of FIG. 3 according to an exemplary embodiment of the inventive concept.

FIG. 3 is a block diagram illustrating a pixel driver included in the display device of FIG. 1 according to an exemplary embodiment of the inventive concept. FIG. 4 is a circuit diagram illustrating a pixel driving signal generator included in the pixel driver of FIG. 3 according to an exemplary embodiment of the inventive concept. FIG. 5 is a circuit diagram illustrating a pixel driving signal generator included in the pixel driver of FIG. 3 according to an exemplary embodiment of the inventive concept.

Referring to FIG. 3, a pixel driver 200 may include a plurality of stages ST1, ST2, and ST3. Each of the stages ST1, ST2, and ST3 may include a pixel driving signal generator 210, a shift register 220, and a selection circuit 230. The pixel driver 200 of FIG. 3 may correspond to the scan driver 140 of FIG. 1. Alternatively, the pixel driver 200 of FIG. 3 may correspond to the emission control driver 150 of FIG. 1.

The pixel driving signal generator 210 may generate a pixel driving signal PDS. The pixel driving signal PDS generated by the pixel driving signal generator 210 of the current stage may be supplied to the pixel driving signal generator 210 of the next stage. The pixel driving signal generator 210 may be dependently connected. The pixel driving signal PDS generated by the pixel driving signal generator 210 of an $n^{th}$ stage may be supplied as a carry signal CR to the pixel driving signal generator 210 of an $(n+1)^{th}$ stage, where n is a natural number greater than or equal to 1. Accordingly, the pixel driving signal generators 210 included in the respective stages may sequentially generate the pixel driving signal PDS. In addition, the pixel driving signal PDS generated by the pixel driving signal generator 210 may be supplied to the shift register 220.

In an exemplary embodiment of the inventive concept, the pixel driving signal generator 210 may generate the scan signal SS. The pixel driving signal generator 210 may sequentially generate the scan signal SS during a data writing period in which the data signal is written in one frame. Referring to FIG. 4, the pixel driving signal generator 210 may include first to eighth switching elements M1, M2, M3, M4, M5, M6, M7, and M8, and first and second capacitors C1 and C2.

The first switching element M1 may include a gate electrode configured to receive a first clock signal CLK1, a first electrode configured to receive the carry signal CR (or the vertical start signal), and a second electrode connected to the first node N1.

The second switching element M2 may include a gate electrode connected to the second node N2, a first electrode connected to the third switching element M3, and a second electrode configured to receive a second voltage VGL.

The third switching element M3 may include a gate electrode configured to receive a second clock signal CLK2, a first electrode connected to the first node N1, and a second electrode connected to the second switching element M2.

The fourth switching element M4 may include a gate electrode connected to the first node N1, a first electrode configured to receive the first clock signal CLK1, and a second electrode connected to the second node N2.

The fifth switching element M5 may include a gate electrode configured to receive the first clock signal CLK1, a first electrode configured to receive a first voltage VGH, and a second electrode connected to the second node N2.

The sixth switching element M6 may include a gate electrode configured to receive the first voltage VGH, a first electrode connected to the first node N1, and a second electrode connected to the third node N3.

The seventh switching element M7 may include a gate electrode connected to the third node N3, a first electrode configured to receive the second clock signal CLK2, and a second electrode connected to an output node NO.

The eighth switching element M8 may include a gate electrode connected to the second node N2, a first electrode connected to the output node NO, and a second electrode configured to receive the second voltage VGL.

The first capacitor C1 may include a first electrode connected to the third node N3 and a second electrode connected to the output node NO.

The second capacitor C2 may include a first electrode connected to the second node N2 and a second electrode configured to receive the second voltage VGL.

The pixel driving signal generator 210 of FIG. 4 may output the scan signal SS through the output node NO according to voltages of the second node N2 and the third node N3. In other words, when the seventh switching element M7 is turned on in response to the voltage of the third node N3, the pixel driving signal generator 210 may output the second clock signal CLK2 as the scan signal SS, and when the eighth switching element M8 is turned on in response to the voltage of the second node N2, the pixel driving signal generator 210 may output the second voltage VGL as the scan signal SS.

In an exemplary embodiment of the inventive concept, the pixel driving signal generator 210 may generate the emission control signal EM. The pixel driving signal generator 210 may sequentially generate the emission control signal EM during an emission period in which the pixel emits light in one frame. Referring to FIG. 5, the pixel driving signal generator 210 may include first to tenth switching elements M1, M2, M3, M4, M5, M6, M7, M8, M9, and M10, and first to third capacitors C1, C2, and C3.

The first switching element M1 may include a gate electrode configured to receive the first clock signal CLK1, a first electrode configured to receive the carry signal CR (or the vertical start signal), and a second electrode connected to the first node N1.

The second switching element M2 may include a gate electrode connected to the second node N2, a first electrode connected to the third switching element M3, and a second electrode connected to the second voltage VGL.

The third switching device M3 may include a gate electrode configured to receive the second clock signal CLK2, a first electrode connected to the first node N1, and a second electrode connected to the second switching device M2.

The fourth switching element M4 may include a gate electrode connected to the first node N1, a first electrode configured to receive the first clock signal CLK1, and a second electrode connected to the second node N2.

The fifth switching element M5 may include a gate electrode configured to receive the first clock signal CLK1, a first electrode configured to receive the first voltage VGH, and a second electrode connected to the second node N2.

The sixth switching element M6 may include a gate electrode configured to receive the second clock signal CLK2, a first electrode connected to the third node N3, and a second electrode connected to the fourth node N4.

The seventh switching element M7 may include a gate electrode connected to the second node N2, a first electrode configured to receive the second clock signal CLK2, and a second electrode connected to the third node N3.

The eighth switching element M8 may include a gate electrode connected to the first node N1, a first electrode connected to the fourth node N4, and a second electrode configured to receive the second voltage VGL.

The ninth switching element M9 may include a gate electrode connected to the fourth node N4, a first electrode connected to the output node NO, and a second electrode configured to receive the second voltage VGL.

The tenth switching element M10 may include a gate electrode connected to the first node N1, a first electrode configured to receive the first voltage VGH, and a second electrode connected to the output node NO.

The pixel driving signal generator 210 of FIG. 5 may output the emission control signal EM through the output node NO according to voltages of the first node N1 and the fourth node N4. In other words, when the tenth switching element M10 is turned on in response to the voltage of the first node N1, the pixel driving signal generator 210 may output the first voltage VGH as the emission control signal EM, and when the ninth switching element M9 is turned on in response to the voltage of the fourth node N4, the pixel driving signal generator 210 may output the second voltage VGL as the emission control signal EM.

Referring back to FIG. 3, the shift register 220 may receive the image data DATA and the pixel driving signal PDS. In this case, the image data DATA may be data for displaying the image only on the partial area of the display panel (e.g., partial display). The shift register 220 may generate an output control signal CTLO for determining whether to output the pixel driving signal PDS based on the image data DATA and the pixel driving signal PDS. The shift register 220 of the stage corresponding to the area where the image is displayed may generate the output control signal CTLO for allowing the selection circuit 230 to output the pixel driving signal PDS. On the other hand, the shift register 220 of the stage corresponding to the area where the image is not displayed may generate the output control signal CTLO for allowing the selection circuit 230 to output the off signal VOFF.

The selection circuit 230 may selectively output the pixel driving signal PDS or the off signal VOFF in response to the output control signal CTLO. The selection circuit 230 may output the pixel driving signal PDS or the off signal VOFF in response to the output control signal CTLO. The selection circuit 230 of the stage corresponding to the area where the image is displayed may output the pixel driving signal PDS, and the selection circuit 230 of the stage corresponding to the area where the image is not displayed may output the off signal VOFF.

Figure 6:
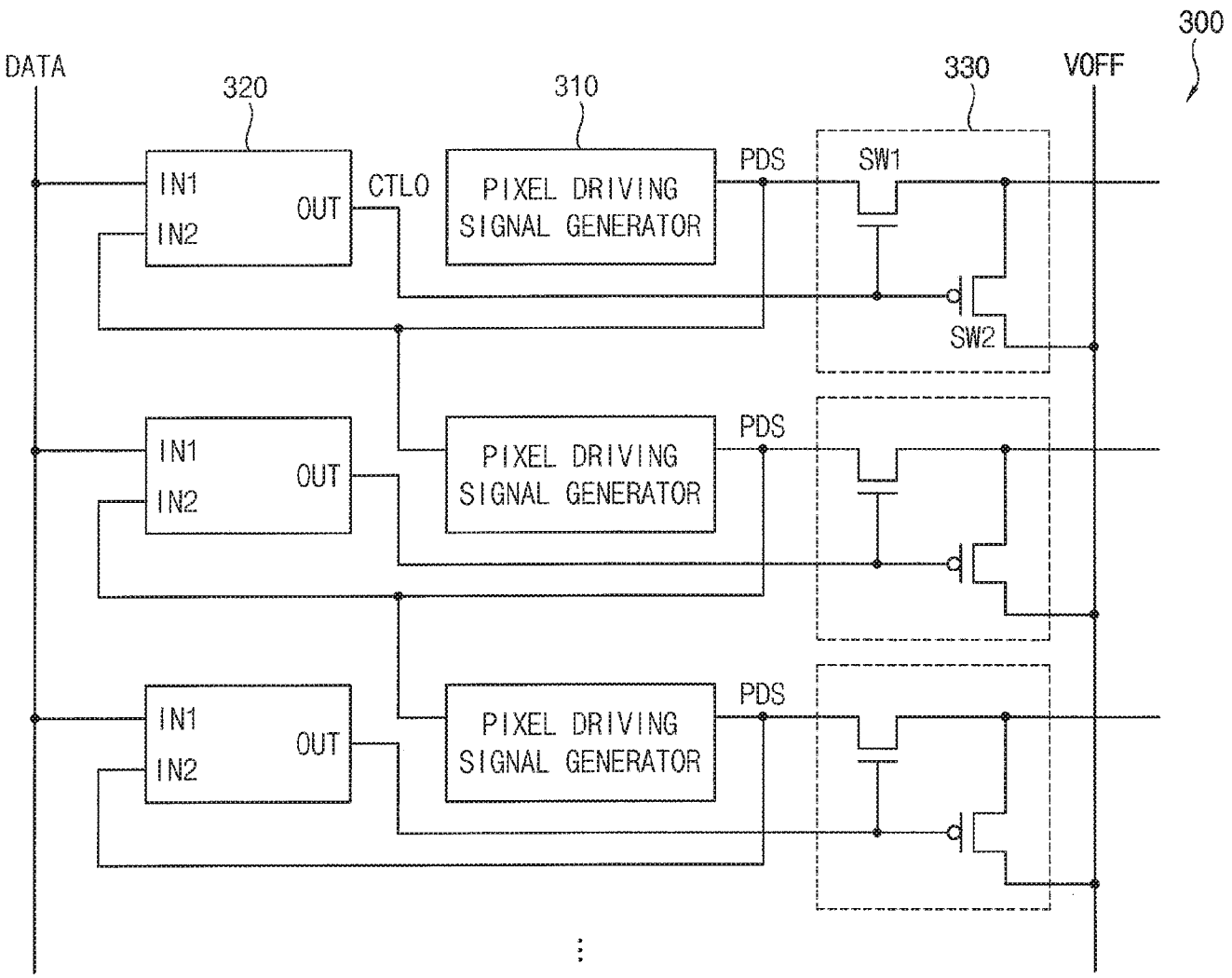
FIG. 6 is a diagram illustrating a pixel driver included in the display device of FIG. 1 according to an exemplary embodiment of the inventive concept.
Figure 7A:
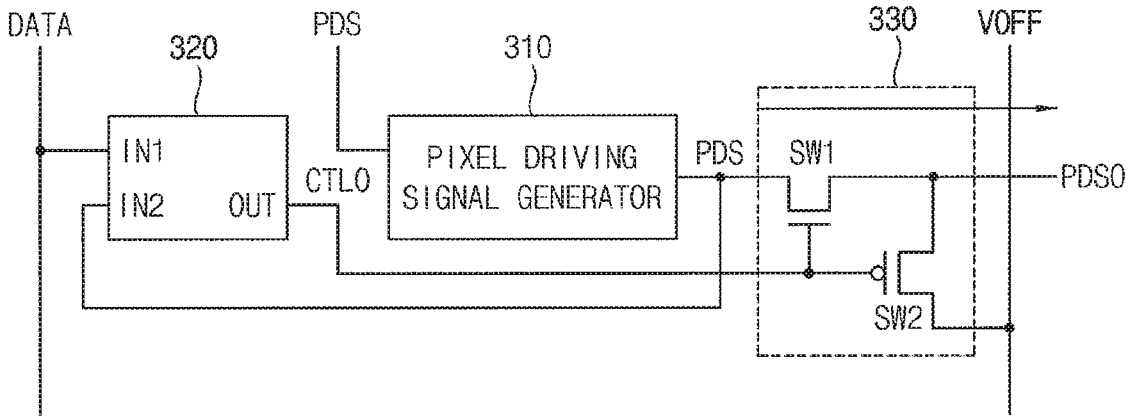
FIGS. 7A and 7B are diagrams for describing an operation of the pixel driver of FIG. 6 according to an exemplary embodiment of the inventive concept.
Figure 7B:
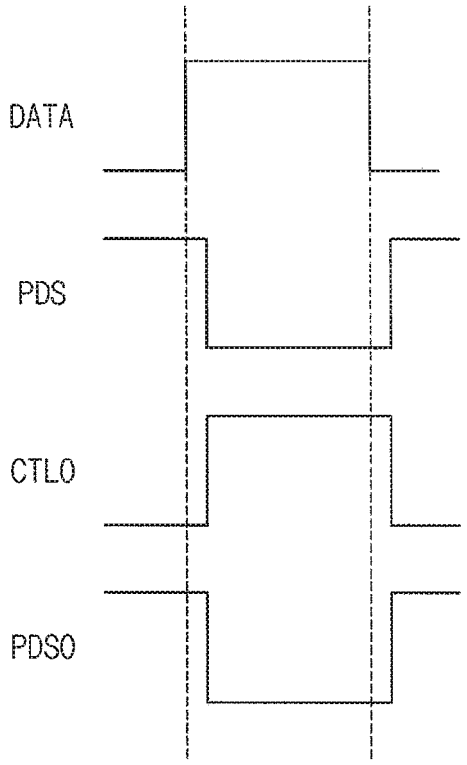
Figure 8A:
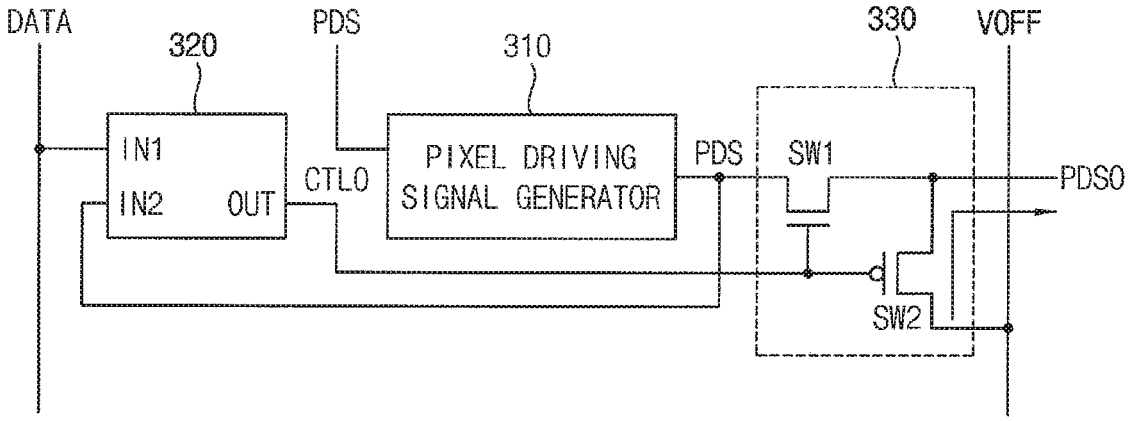
FIGS. 8A and 8B are diagrams for describing an operation of the pixel driver of FIG. 6 according to an exemplary embodiment of the inventive concept.
Figure 8B:
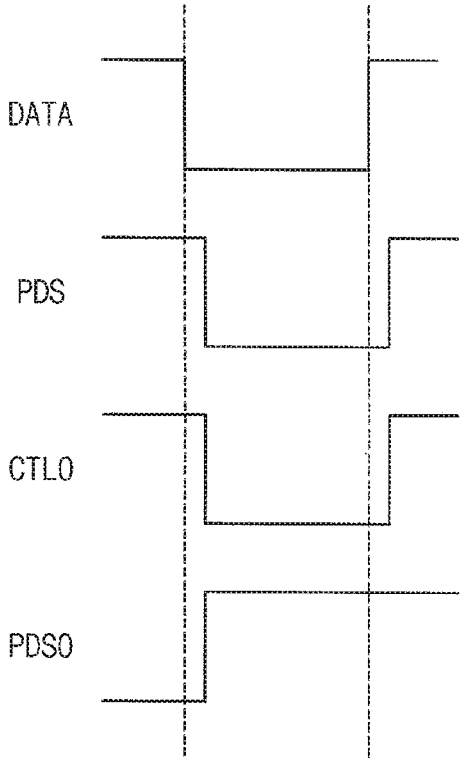

FIG. 6 is a diagram illustrating a pixel driver included in the display device of FIG. 1 according to an exemplary embodiment of the inventive concept. FIGS. 7A and 7B are diagrams for describing an operation of the pixel driver of FIG. 6 according to an exemplary embodiment of the inventive concept. FIGS. 8A and 8B are diagrams for describing an operation of the pixel driver of FIG. 6 according to an exemplary embodiment of the inventive concept.

Referring to FIG. 6, a pixel driver 300 may include a plurality of stages, wherein each of the stages may include a pixel driving signal generator 310, a shift register 320, and a selection circuit 330. The pixel driver 300 of FIG. 6 may correspond to the pixel driver 200 of FIG. 3.

The pixel driving signal generator 310 may generate a driving signal. The pixel driving signal PDS generated by the pixel driving signal generator 310 may be supplied to the shift register 320. In addition, the pixel driving signal PDS generated by the pixel driving signal generator 310 of the current stage may be supplied to the pixel driving signal generator 310 of the next stage. The pixel driving signal generator 310 may be dependently connected. In other words, the pixel driving signal PDS generated by the pixel driving signal generator 310 of an $n^{th}$ stage may be supplied as a carry signal to the pixel driving signal generator 310 of an $(n+1)^{th}$ stage. In an exemplary embodiment of the inventive concept, the pixel driving signal generator 310 may generate a scan signal. In an exemplary embodiment of the inventive concept, the pixel driving signal generator 310 may generate an emission control signal.

The shift register 320 may receive the image data DATA and the pixel driving signal PDS to output the output control signal CTLO based on the image data DATA and the pixel driving signal PDS. The shift register 320 may include a first input terminal IN1 configured to receive the image data DATA, a second input terminal IN2 configured to receive the pixel driving signal PDS, and an output terminal OUT at which the output control signal CTLO is output. The shift register 320 may generate the output control signal CTLO for determining whether to output the pixel driving signal PDS based on the image data DATA and the pixel driving signal PDS.

The selection circuit 330 may include a first switch SW1 and a second switch SW2. The first switch SW1 may output the pixel driving signal PDS based on the output control signal CTLO. The second switch SW2 may output the off signal VOFF having a preset voltage level based on the output control signal CTLO. For example, the first switch SW1 may be a first-type switching element, and the second switch SW2 may be a second-type switching element. The first-type switching element may be an NMOS transistor, and the second-type switching element may be a PMOS transistor.

Referring to FIGS. 7A and 7B, the image data DATA having a high level (e.g., data for displaying an image) may be supplied to the first input terminal IN1 of the shift register 320, and the pixel driving signal PDS having a low level may be supplied to the second input terminal IN2 of the shift register 320. The pixel driving signal PDS may be supplied as a clock signal to the shift register 320. The shift register 320 may generate the output control signal CTLO having a high level based on the image data DATA and the pixel driving signal PDS and supply the output control signal CTLO to the selection circuit 330 through the output terminal OUT.

In response to the output control signal CTLO having the high level, the first switch SW1 may be turned on, and the second switch SW2 may be turned off. When the first switch SW1 is turned on, the pixel driving signal PDS generated by the pixel driving signal generator 310 may be output as an output driving signal PDSO to the pixels of the display panel through the first switch SW1. The output driving signal PDSO output to the pixels may have a voltage level for turning on a switching element of the pixels connected to the selection circuit 330. As shown in FIG. 2, when the switching element of the pixel connected to the selection circuit 330 is a PMOS transistor, the output driving signal PDSO output from the pixel driver 300 may have a low level.

FIG. 7B illustrates a case where the pixel driving signal generator 310 of the pixel driver 300 generates the pixel driving signal PDS having a low level, the shift register 320 generates the output control signal CTLO in response to the pixel driving signal PDS having the low level, and the selection circuit 330 outputs the output driving signal PDSO having a low level to the pixels of the display panel, but an operation of the pixel driver 300 is not limited thereto. For example, when the switching element of the pixel connected to the selection circuit 330 is an NMOS transistor, the pixel driving signal generator 310 of the pixel driver 300 may generate the pixel driving signal PDS having a high level, the shift register 320 may generate the output control signal CTLO in response to the pixel driving signal PDS having the high level, and the selection circuit 330 may output the output driving signal PDSO having a high level to the pixels of the display panel.

Referring to FIGS. 8A and 8B, the image data DATA having a low level (e.g., data that cannot display an image) may be supplied to the first input terminal IN1 of the shift register 320, and the pixel driving signal PDS having a low level may be supplied to the second input terminal IN2 of the shift register 320. The pixel driving signal PDS may be supplied as a clock signal to the shift register 320. The shift register 320 may generate the output control signal CTLO having a low level based on the image data DATA and the pixel driving signal PDS and supply the output control signal CTLO to the selection circuit 330 through the output terminal OUT.

In response to the output control signal CTLO having the low level, the first switch SW1 may be turned off, and the second switch SW2 may be turned on. When the second switch SW2 is turned on, the off signal VOFF may be output as the output driving signal PDSO to the pixels of the display panel through the second switch SW2. The output driving signal PDSO output to the pixels may have a voltage level for turning off a switching element of the pixels connected to the selection circuit 330. As shown in FIG. 2, when the switching element of the pixel connected to the selection circuit 330 is a PMOS transistor, the output driving signal PDSO output from the pixel driver 300 may have a high level.

FIG. 8B illustrates a case where the pixel driving signal generator 310 of the pixel driver 300 generates the pixel driving signal PDS having a low level, the shift register 320 generates an output control signal CTLO in response to the pixel driving signal PDS having the low level, and the selection circuit 330 outputs the output driving signal PDSO having a high level to the pixels of the display panel, but the operation of the pixel driver 300 is not limited thereto. For example, when the switching element of the pixel connected to the selection circuit 330 is an NMOS transistor, the pixel driving signal generator 310 of the pixel driver 300 may generate the pixel driving signal PDS having a high level, the shift register 320 may generate the output control signal CTLO in response to the pixel driving signal PDS having the high level, and the selection circuit 330 may output the off signal VOFF having a low level to the pixels of the display panel as the output driving signal PDSO.

As described above, in the pixel driver 300 included in the display device according to exemplary embodiments of the inventive concept, each of the stages includes the shift register 320 and the selection circuit 330, so that the pixel driving signal PDS or the off signal VOFF may be selectively output for each stage. Accordingly, the pixel driving signal PDS is not supplied to the area where the image is not displayed, so that the power consumption can be reduced. In addition, the pixel driving signal PDS or the off signal VOFF is selectively output for each stage to facilitate the partial display driving.

Figure 9:
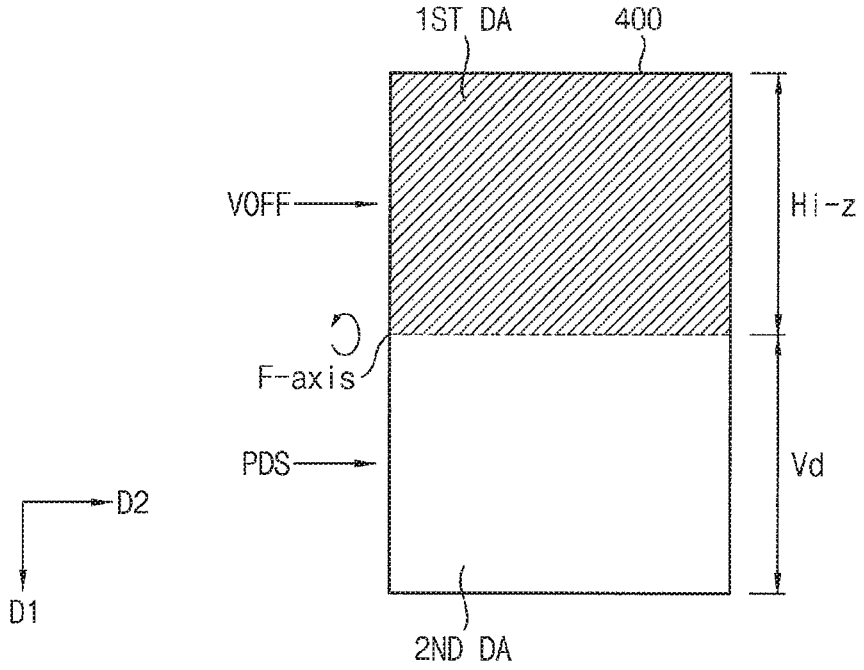
FIGS. 9 and 10 are diagrams for describing an operation of the display device of FIG. 1 according to exemplary embodiments of the inventive concept.
Figure 10:
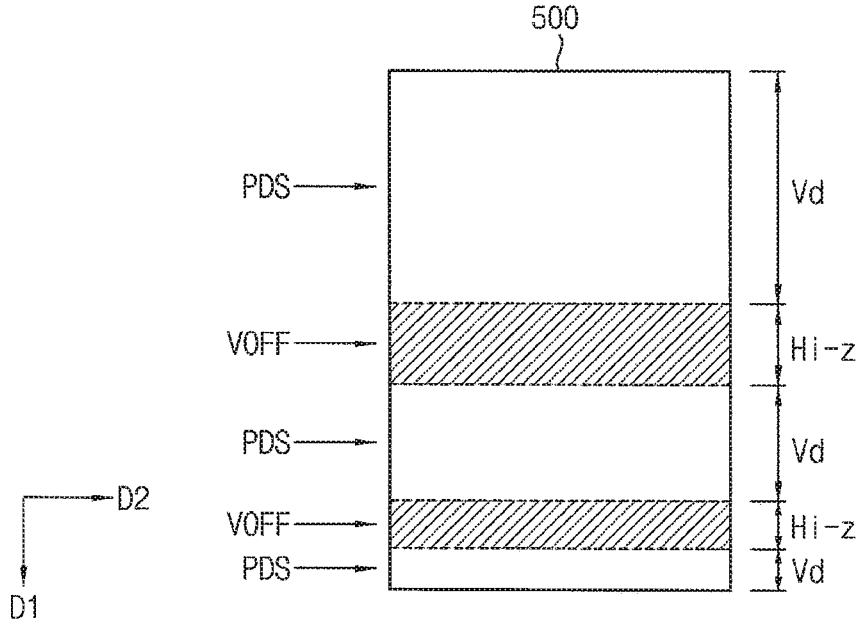

FIGS. 9 and 10 are diagrams for describing an operation of the display device of FIG. 1 according to exemplary embodiments of the inventive concept.

Referring to FIG. 9, a display panel 400 may be a foldable display panel. The foldable display panel may include a first display area 1ST DA and a second display area 2ND DA. The foldable display panel may be folded about a folding axis F-axis. In this case, the folding axis F-axis may be substantially parallel to the scan lines and the emission control lines extending in the second direction D2. When the foldable display panel is folded out about the folding axis F-axis, the user may view only the second display area 2ND DA. Accordingly, the image is not displayed in the first display area 1ST DA, so that the power consumption of the display device can be reduced.

According to an exemplary embodiment of the inventive concept, the pixel driver of the display device may supply the pixel driving signal PDS (e.g., the scan signal and the emission control signal) to the second display area 2ND DA where the image is displayed, and may supply the off signal VOFF to the first display area 1ST DA where the image is not displayed. In addition, according to an exemplary embodiment of the inventive concept, the data driver of the display device may supply the data signal Vd corresponding to the image to the second display area 2ND DA where the image is displayed, and may not supply a data signal (Hi-z) to the first display area 1ST DA where the image is not displayed.

Referring to FIG. 10, the display device may perform the partial display driving to display the image corresponding to the image data on a partial area of the display panel 500. According to an exemplary embodiment of the inventive concept, the pixel driver of the display device may supply the pixel driving signal PDS (e.g., the scan signal and the emission control signal) to the area where the image is displayed, and may supply the off signal VOFF to the area where the image is not displayed. In addition, according to an exemplary embodiment of the inventive concept, the data driver of the display device may supply the data signal Vd corresponding to the image to the area where the image is displayed, and may not supply a data signal (Hi-z) to the area where the image is not displayed. In an exemplary embodiment of the inventive concept, when the partial display driving is performed, the display device may change a position of the area where the image is not displayed to prevent an afterimage from appearing on the display panel.

As described above, according to an exemplary embodiment of the inventive concept, the display device includes the pixel driver which allows the stages of the pixel driver to selectively output the pixel driving signal PDS and the off signal VOFF, so that power consumption can be reduced when the partial display driving is performed. In addition, each of the stages of the pixel driver selectively outputs the pixel driving signal PDS and the off signal VOFF to facilitate the partial display driving.

The inventive concept may be applied to any electronic device including a display device. For example, the inventive concept may be applied to a television, a computer monitor, a laptop, a digital camera, a cellular phone, a smart phone, a smart pad, a tablet personal computer (PC), a personal digital assistant (PDA), a portable multimedia player (PMP), an MP3 player, a car navigation system, a video phone, a head mounted display (HMD) device, etc.

As described above, a pixel driver and a display device according to exemplary embodiments of the inventive concept may reduce power consumption when a partial display driving, by which an image is displayed on a partial area of a display panel, is performed, by allowing stages of the pixel driver to selectively output a pixel driving signal and an off signal. In addition, the pixel driver and the display device may facilitate the partial display driving by allowing each of the stages to control whether to output the pixel driving signal or the off signal.

While the inventive concept has been shown and described with reference to exemplary embodiments thereof, it will be apparent to those of ordinary skill in the art that various modifications in form and details may be made thereto without departing from the spirit and scope of the inventive concept as set forth by the appended claims.

What is claimed is:

1. A pixel driver comprising:

a plurality of stages, wherein each of the plurality of stages includes:

a pixel driving signal generator configured to generate a pixel driving signal;

a shift register configured to receive image data and the pixel driving signal and to generate an output control signal for determining whether to output the pixel driving signal based on the image data and the pixel driving signal; and a selection circuit configured to selectively output the pixel driving signal or an off signal having a preset voltage level in response to the output control signal.

2. The pixel driver of claim 1, wherein the pixel driving signal includes a scan signal.

3. The pixel driver of claim 1, wherein the pixel driving signal includes an emission control signal.

4. The pixel driver of claim 1, wherein the pixel driving signal generated by a pixel driving signal generator of an $n^{th}$ stage is supplied as a carry signal to a pixel driving signal generator of an $(n+1)^{th}$ stage, where n is a natural number greater than or equal to 1.

5. The pixel driver of claim 1, wherein the shift register includes:

a first input terminal to which the image data is applied;

a second input terminal to which the pixel driving signal is applied; and an output terminal at which the output control signal is output.

6. The pixel driver of claim 1, wherein the selection circuit includes:

a first switch configured to output the pixel driving signal in response to the output control signal; and a second switch configured to output the off signal in response to the output control signal.

7. The pixel driver of claim 6, wherein the first switch includes a first-type switching element, and the second switch includes a second-type switching element.

8. A display device comprising:

a display panel including a plurality of pixels;

a data driver configured to supply a data signal to the plurality of pixels;

a pixel driver including a plurality of stages, and configured to supply a pixel driving signal to the plurality of pixels; and a timing controller configured to generate control signals for controlling the data driver and the pixel driver, wherein each of the plurality of stages includes:

a pixel driving signal generator configured to generate the pixel driving signal;

a shift register configured to receive image data and the pixel driving signal and to generate an output control signal for determining whether to output the pixel driving signal based on the image data and the pixel driving signal; and a selection circuit configured to selectively output the pixel driving signal or an off signal having a preset voltage level in response to the output control signal.

9. The display device of claim 8, wherein the pixel driver includes a scan driver, and the pixel driving signal includes a scan signal.

10. The display device of claim 8, wherein the pixel driver includes an emission control driver, and the pixel driving signal includes an emission control signal.

11. The display device of claim 8, wherein the pixel driving signal generated by a pixel driving signal generator of an $n^{th}$ stage is supplied as a carry signal to a pixel driving signal generator of an $(n+1)^{th}$ stage, where n is a natural number greater than or equal to 1.

12. The display device of claim 8, wherein the shift register includes:

a first input terminal to which the image data is applied;

a second input terminal to which the pixel driving signal is applied; and an output terminal at which the output control signal is output.

13. The display device of claim 8, wherein the selection circuit includes:

a first switch configured to output the pixel driving signal in response to the output control signal; and a second switch configured to output the off signal in response to the output control signal.

14. The display device of claim 13, wherein the first switch includes a first-type switching element, and the second switch includes a second-type switching element.

15. The display device of claim 8, wherein the display device performs a partial display driving to display an image, corresponding to the image data, on a partial area of the display panel.

16. The display device of claim 15, wherein stages among the plurality of stages, corresponding to an area where the image is not displayed, supply the off signal to corresponding pixels.

17. The display device of claim 15, wherein the data driver is configured not to supply the data signal to pixels included in an area where the image is not displayed.

18. The display device of claim 8, wherein the display panel includes a foldable display panel.

19. The display device of claim 18, wherein stages among the plurality of stages, corresponding to a folded area of the foldable display panel, in the pixel driver supply the off signal to corresponding pixels.

20. The display device of claim 18, wherein the data driver is configured not to supply the data signal to pixels included in a folded area of the foldable display panel.

21. A pixel driver comprising:

a plurality of stages, wherein an $n^{th}$ stage of the plurality of stages includes:

a pixel driving signal generator configured to generate a scan signal or an emission control signal as a pixel driving signal and output the pixel driving signal to a shift register and an $(n+1)^{th}$ stage;

the shift register configured to receive image data and the pixel driving signal, to generate an output control signal based on the image data and the pixel driving signal, and output the output control signal to a selection circuit; and the selection circuit configured to receive the output control signal and to output one of the pixel driving signal or an off signal in response to the output control signal, and wherein n is a natural number greater than or equal to 1.

* * * * *